US005211111A

United States Patent [19]

Quinci

[11] Patent Number: 5,211,111

[45] Date of Patent: May 18, 1993

[54] PRINTING PRESS HAVING MEANS FOR INDEXING PLATE CYLINDER

[75] Inventor: Emanuel Quinci, Dix Hills, N.Y.

[73] Assignee: Halm Industries Co., Inc., Glen Cove, N.Y.

[21] Appl. No.: 921,503

[22] Filed: Jul. 29, 1992

[51] Int. Cl.[5] ..... B41F 13/14

[52] U.S. Cl. ..... 101/248; 74/395

[58] Field of Search ..... 101/247, 248, 217, 216, 101/181, 485, 486; 74/395, 396, 397, 398, 399

[56] References Cited

U.S. PATENT DOCUMENTS

| | | | |
|---|---|---|---|
| 3,630,145 | 12/1971 | Leuenberger | 74/395 |
| 3,793,899 | 2/1974 | Bourbonnaud | 74/397 |
| 4,006,685 | 2/1977 | Mosemiller | 101/248 |
| 4,100,851 | 7/1978 | Jahn | 101/248 |
| 4,195,569 | 4/1980 | Liska | 101/248 |
| 4,214,528 | 7/1980 | Mirow | 101/247 |
| 4,363,270 | 12/1982 | Ury et al. | 101/248 |
| 4,787,261 | 11/1988 | Becker | 101/248 |
| 4,833,983 | 5/1989 | Chen | 101/248 |
| 4,922,819 | 5/1990 | Ishii | 61/248 |
| 5,042,380 | 8/1991 | Quinci | 101/248 |

*Primary Examiner*—Eugene H. Eickholt
*Attorney, Agent, or Firm*—Hoffmann & Baron

[57] ABSTRACT

An assembly is provided for indexing the position of a plate cylinder. The assembly includes a drive assembly which is coupled to the plate cylinder, an indexing mechanism which is engageable with the drive assembly, and a shaft which supports the indexing mechanism and rotates it about the axis of the shaft. The drive assembly includes a support and a detent plate which is rotatably and slidably mounted to the support. The detent plate includes tapered or frustoconical openings arranged in a circle upon the plate. The indexing mechanism includes a pin having a tapered head which is insertable into the openings. The detent plate may be moved axially away from the indexing mechanism in order to disengage it from the pin. Once disengaged, the drive assembly and plate cylinder may be rotated with respect to the indexing mechanism and blanket cylinder to allow a different image on the surface of the plate cylinder to be transferred to the blanket cylinder.

17 Claims, 3 Drawing Sheets

PRINTING PRESS HAVING MEANS FOR INDEXING PLATE CYLINDER

BACKGROUND OF THE INVENTION

1. Field Of The Invention

The field of the invention relates to sheet type printing presses used for performing many different printing jobs without changing a printing plate.

2. Brief Description Of The Prior Art

A sheet press generally comprises one or more plate cylinders, a blanket cylinder, and an impression cylinder. One of the plate cylinders is typically driven by a power source. A gear drive is provided for coupling these two elements. Ink is provided to an etched plate mounted to the outer surface of the plate cylinder. This ink is transferred by the engagement of the outer surfaces of the plate and blanket cylinders, the latter having an outside surface defined by ink receptive blanket material. The paper to be printed passes between the blanket and impression cylinders. A precise gearing arrangement maintains the relative positions of the plate and blanket cylinders when the press is in operation.

Many printing jobs require the printing of only a few hundred or a few thousand items. Multiple images may accordingly be provided on a plate on a plate cylinder, one image for each printing job. When a job is completed, the plate cylinder is rotated with respect to the blanket cylinder until the next image is properly aligned therewith. Once the blanket cylinder has been cleaned, the next job can be run.

In order to operate efficiently, it is important for the plate cylinder to be quickly and easily rotated by the operator in a manner that will insure the selected image is properly aligned with respect to the blanket cylinder in an offset printing operation or the workpiece in direct lithography. The speed at which such a changeover can be effected is important in maximizing the number of jobs which can be performed in a selected amount of time. It is equally important for the image to be properly aligned so that workpieces are not wasted.

One approach for rotating a plate cylinder with respect to a blanket cylinder is disclosed in commonly assigned U.S. Pat. No. 5,042,380. This approach involves the use of a double harmonic drive assembly which can change the phase of a plate cylinder with respect to a blanket cylinder as the press operates.

SUMMARY OF THE INVENTION

It is an object of the invention to provide a printing press having a plate cylinder which can be easily rotated by an operator with respect to a blanket cylinder or a workpiece.

It is another object of the invention to provide a plate cylinder adjustment assembly which allows a plate cylinder to be properly registered with a blanket cylinder so that workpieces are not wasted subsequent to a job changeover.

In accordance with these and other objects of the invention, an assembly is provided for allowing the operator to manually adjust the rotational position of a plate cylinder to a position corresponding to a selected image. The assembly includes a plate cylinder, means for rotatably supporting the plate cylinder, drive means coupled to and rotatable with the plate cylinder, the drive means including a detent plate having a plurality of recesses therein, and a support for the detent plate. Preferably, means are provided for resiliently urging the detent plate away from the support. Indexing means are provided for selectively engaging and disengaging one of the recesses within the detent plate. Means are provided for supporting the indexing means such that the detent plate is rotatable with respect thereto upon disengagement of the indexing means from the recess. The indexing means, supporting means, detent plate and plate cylinder rotate together when the indexing means engages one of the recesses. The indexing means preferably includes a pin. The assembly is incorporated as part of a printing press including other cylinders employed in a printing operation. In the preferred embodiment of the invention, offset printing is employed through the use of blanket and impression cylinders.

DETAILED DESCRIPTION OF THE INVENTION

Figure 1:
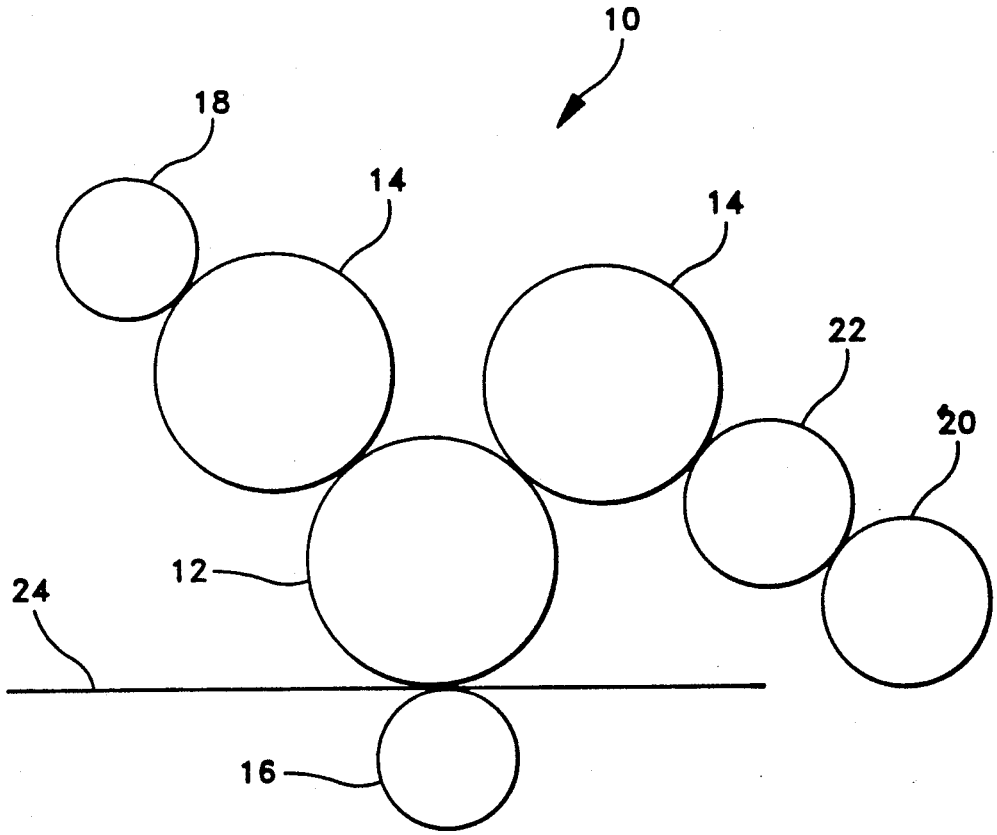
FIG. 1 is a schematic illustration of a sheet type printing press in accordance with the invention.

A sheet type printing press 10 as shown in FIG. 1 is provided by the invention. The press includes a blanket cylinder 12, one or more plate cylinders 14, and an impression cylinder 16. Each of the plate cylinders includes a cylindrical surface provided with a plurality of images etched therein. A form roller 18 or the like provides ink to the plate cylinder which, in turn, transfers it to the blanket cylinder 12. Each plate cylinder typically transfers a different color ink to the blanket cylinder.

The plate cylinders may be driven in a number of ways. In the embodiment shown in FIG. 1, a drive gear 20 connected to a motor (not shown) drives an idler gear 22 which, in turn, drives one of the plate cylinders. This plate cylinder drives the blanket cylinder while the blanket cylinder drives the other of the two plate cylinders.

The substrate 24 to be printed is passed between the blanket and impression cylinders. Sheet presses are designed for printing pre-cut articles such as paper envelopes. Each article receives a precisely metered amount of ink from the blanket cylinder in a precise location. The plate cylinders and blanket cylinder are all rotated by interengaged drive gears which maintain their alignment as the press is running. Since all of the interconnected gears are under load in operation, there is little chance of the cylinders becoming displaced with respect to each other and causing the images imparted to the blanket cylinder to be misregistered.

In a typical operation for running multiple printing jobs, each of the images etched upon the plates mounted to a plate cylinder is employed for a separate job. The plate cylinder must be rotated with respect to the blanket cylinder once one job has been completed in order to start the next job. A selected image on the plate cylinder is properly aligned with the blanket cylinder upon such rotation. The blanket cylinder should be cleaned before the next job is begun in order to remove the previously transferred image therefrom.

Figure 2:
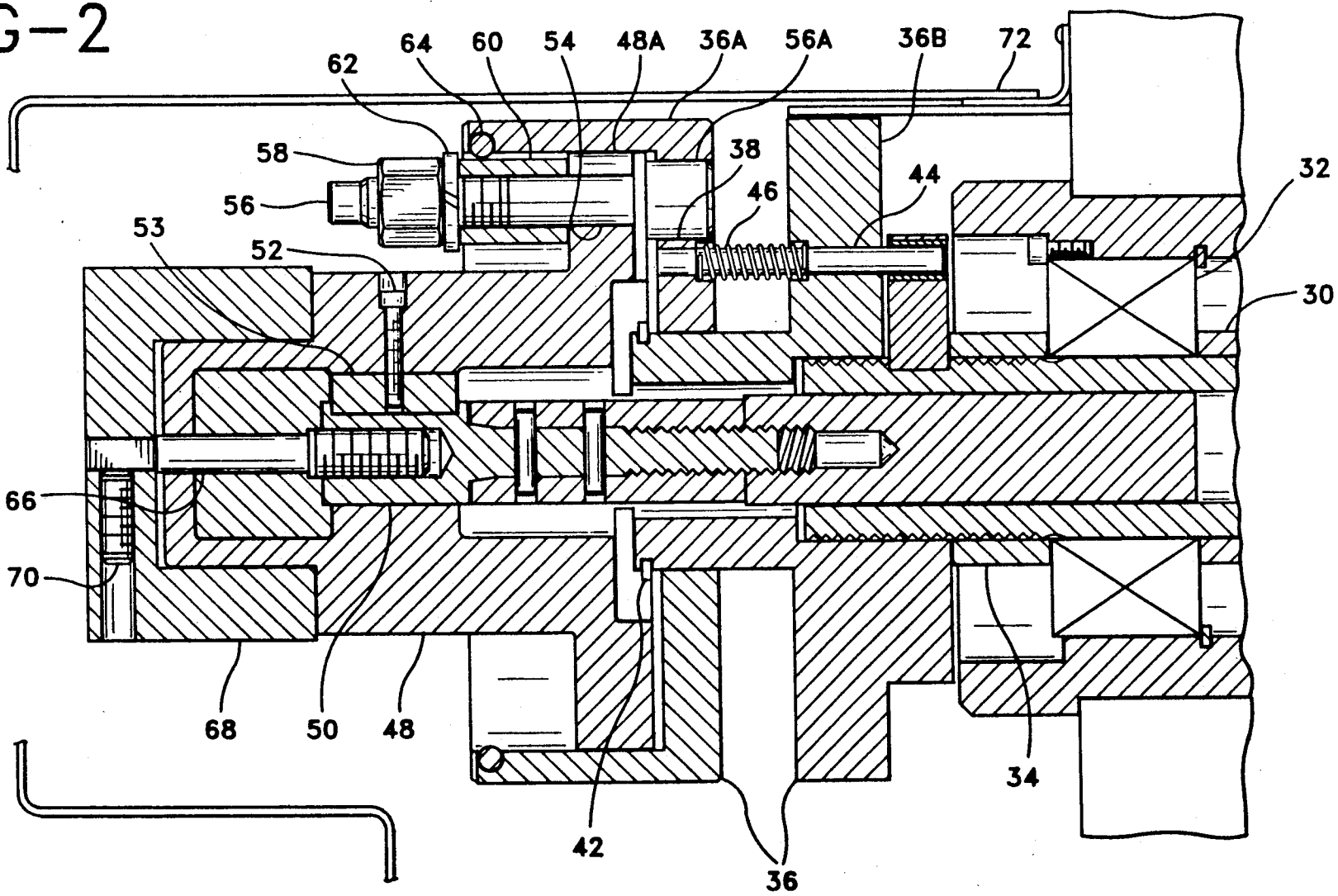
FIG. 2 is a sectional side elevation view of a portion of said press.
Figure 3:
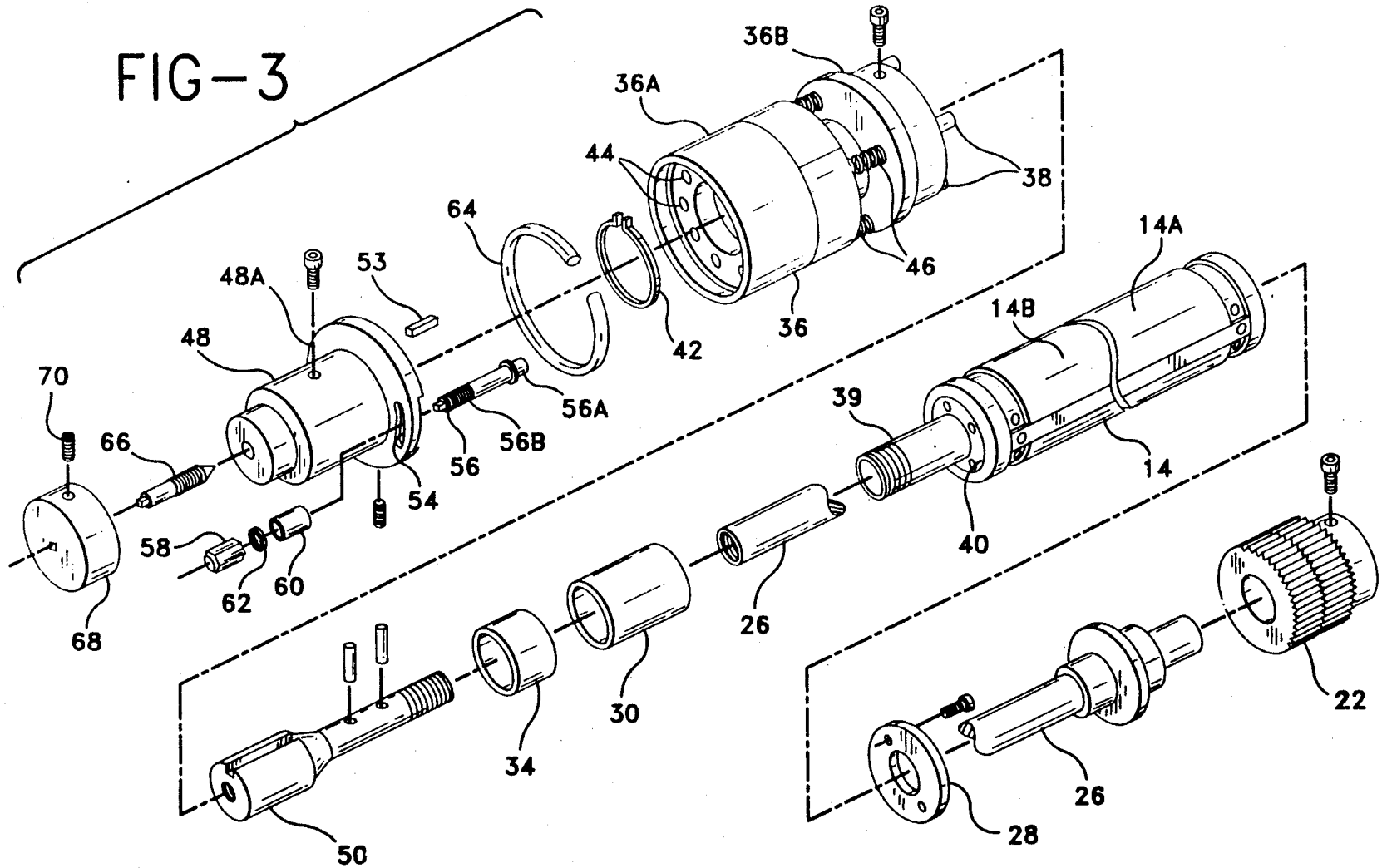
FIG. 3 is an exploded, perspective view of an assembly for rotating a plate cylinder of the press with respect to the blanket cylinder.

An assembly as shown in FIGS. 2 and 3 is provided for efficiently performing a number of different printing jobs. The assembly includes a plate cylinder 14 having selected images 14A, 14B, etc. provided thereon (FIG. 3). The plate cylinder is rotatably mounted to a plate cylinder shaft 26 which is driven by an anti-backlash gear 22. A spacer 28 is mounted to one end of the plate cylinder. A bearing assembly (not shown) may be provided for supporting one end of the shaft. The bearing assembly adjoins the spacer 28, and allows the shaft 26 to rotate therein. A second spacer 30 adjoins the other end of the plate cylinder and is mounted in concentric relation to the plate cylinder shaft. A second bearing assembly 32 (FIG. 2) adjoins the second spacer. A third spacer 34 adjoins the opposite side of the second bearing assembly 32.

A flange drive assembly 36 adjoins the third spacer 34, and is coupled to the plate cylinder. The plate cylinder includes a stub shaft 39 extending from a flange 40. The threaded end of the stub shaft is coupled to the flange drive assembly 36 as shown in FIG. 2. The flange drive assembly 36 further includes a first section 36A and a second section 36B. The second section includes a relatively large diameter flange portion from which a set of drive pins 38 extend, and a smaller diameter cylindrical portion. The first section 36A is slidably mounted to the cylindrical portion of the second section 36B. A retaining ring 42 mounted to one end of the second section 36B prevents the first section from being displaced beyond a selected point.

The first section 36A of the flange drive assembly includes a plurality of tapered openings 44 and functions as a detent plate. The number of such openings corresponds to the number of different images to be provided upon the plate cylinder. If twelve images are provided upon the plate cylinder, twelve openings, preferably equally spaced, will be provided within the first section of the flange drive assembly. While the openings preferably extend through the plate, this is not required. A plurality of springs 46 are provided for resiliently urging the first section 36A away from the flange portion of the second section 36B thereof. The springs 46 are supported by the set of pins 38, and drive the first section 36A of the flange drive assembly 36.

A pin supporting member 48 is positioned in adjoining relation to the flange drive assembly 36, and is coaxial therewith. A plate cylinder shaft extension 50 is secured to the plate cylinder shaft 26. It may alternatively be an integral part of the plate cylinder shaft. The pin supporting member 48 is coupled to the extension 50 by a threaded pin 52, and is accordingly rotatable with the plate cylinder shaft. The pin 52 extends through an axially positioned key 53.

The pin supporting member includes a flange 48A in opposing relation to the radially extending portion of the first section 36A of the flange drive assembly 36. An elongate, arcuate opening 54 extends through the flange. A pin 56 extends through the opening 54 and into one of the openings 44 within the first section 36A of the flange drive. The pin 56 includes a tapered end portion 56A which corresponds to the dimensions of the tapered openings 44. It also includes a partially threaded shaft 56B to which a nut 58 is secured. A spacer 60 and a lock washer 62 are positioned on the shaft between the nut 58 and the flange 48A. They insure that the pin 56 is maintained in a desired radial position within the opening 54. The configuration of the opening 54 allows fine adjustments of this position. A ring 64 is positioned within a groove in the inner wall of the first section of the flange drive, and extends radially outside the spacer 60.

A lock screw 66 is secured to the plate cylinder shaft extension 50 and extends coaxially therefrom. A knob 68 is secured to the lock screw 66 by a set screw 70, thereby helping to hold the pin supporting member in position. A removable cover 72 protects the entire coupling assembly.

In operation, the pin supporting member 48 is ordinarily coupled to the flange drive assembly 36 by the axially extending pin 56. Rotation of the anti-backlash gear 22 causes rotation of the plate cylinder shaft 26 and shaft extension 50. The pin supporting member is caused to rotate about its axis by the shaft extension, which in turn causes rotation of the flange drive assembly 36. The plate cylinder 14, being coupled to the flange drive assembly 36 by the pin plate 40 and pins 38, rotates with the flange drive. The blanket cylinder 12 is driven synchronously with the plate cylinder 14 as workpieces 24 are fed between the blanket and impression cylinders. The desired image upon the plate cylinder is inked by the form roller 18. The image is transferred to the blanket cylinder and ultimately to the workpiece.

As discussed above, the plate cylinder is provided with a number of images to be used for separate printing jobs. Once one job has been completed, it is necessary to rotate the plate cylinder with respect to the blanket cylinder so that a new image is inked by the form roller and ultimately transferred to the workpieces. This may be accomplished using only one hand in accordance with the preferred embodiment of the invention.

The plate cylinder 14 is first uncoupled from the drive mechanism 20, 22 by urging the first section 36A of the flange drive assembly 36 towards the second section 36B thereof. The flange drive is thereby moved out of engagement with the pin 56. Upon such disengagement, the flange drive assembly 36 may be rotated until a subsequent opening 44 is aligned with the pin. This causes the simultaneous rotation of the plate cylinder, which at this point is accordingly rotated with respect to the blanket cylinder so that a different image is transferred thereto when the plate and blanket cylinders are again coupled for synchronous operation. Such recoupling occurs upon release of the first section 36A of the flange driven so that the pin 56 is again engaged thereby. The pin accordingly functions as an indexing means. The blanket cylinder is cleaned before commencing the next printing job.

It is, of course, possible to design the above-referenced coupling mechanism so that the pin is axially movable rather than a section of the flange drive assembly. This is not preferred, however, as it requires a two-handed operation which is more difficult and time consuming.

The configuration of the pin head portion 56A and openings 44 have been found to be advantageous in the coupling operation. If the pin head portion wears after extended use, it will simply move further into the respective openings until the walls thereof are engaged. This is important in avoiding a sloppy fit which could affect the location of the image with respect to the workpiece.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for indexing the position of a plate cylinder, comprising:

a plate cylinder having an outer surface;

means for rotatably supporting the plate cylinder;

a drive assembly coupled to the plate cylinder, the drive assembly including a detent member having a plurality of openings therein and a support for supporting the detent member;

indexing means insertable within the openings within the detent member for engaging and disengaging the drive assembly;

means for rotating the indexing means about an axis, the drive assembly and the plate cylinder being rotatable with the indexing means when the indexing means is engaged with the detent member;

the drive assembly and the plate cylinder being rotatable together independently of the indexing means when the indexing means is disengaged from the drive assembly.

2. An assembly as described in claim 1, wherein the detent member is slidably and rotatably mounted to the support, the detent member being slidable between a first position wherein the indexing means are inserted within one of the openings and a second position wherein the indexing means are outside of the openings, the detent member being rotatable with respect to the support when located in the second position.

3. An assembly as described in claim 2, wherein the indexing means include a pin having a tapered head portion, the openings within the detent plate having tapered configurations for receiving the tapered head portion of the pin.

4. An assembly as described in claim 2, wherein the indexing means include a pin supporting member, a pin mounted to the pin supporting member, and means for adjusting the radial position of the pin with respect to the pin supporting member.

5. An assembly as described in claim 4, wherein the means for adjusting the radial position of the pin include an elongate, arcuate slot within the pin supporting member and means for releasably mounting the pin at least partially within the slot.

6. An assembly as described in claim 2, including means for resiliently urging the detent member towards the indexing means.

7. An assembly as described in claim 1, wherein the plate cylinder includes a plurality of images upon the outer surface thereof, each of the openings within the detent member being aligned with one of the images.

8. An assembly as described in claim 1, wherein the indexing means include a pin having a tapered head portion, the openings within the detent member having tapered configurations for receiving the tapered head portion of the pin.

9. An assembly as described in claim 2, wherein the means for rotating the index means include a shaft assembly, a gear secured to the shaft assembly, the indexing means being secured to and rotatable with the shaft assembly.

10. A printing press comprising:

a plate cylinder;

a blanket cylinder engageably with the plate cylinder;

means for rotatably supporting the plate cylinder;

a drive assembly coupled to the plate cylinder, the drive assembly including a detent member having a plurality of openings therein and a support for supporting the detent member;

indexing means insertable within the openings within the detent member for engaging and disengaging the drive assembly;

means for rotating the indexing means about an axis, the drive assembly and the plate cylinder being rotatable with the indexing means and the blanket cylinder when the indexing means is engaged with the detent member;

the drive assembly and the plate cylinder being rotatable together independently of the indexing means and blanket cylinder when the indexing means is disengaged from the drive assembly.

11. An assembly as described in claim 10, wherein the detent member is slidably and rotatably mounted to the support, the detent member being slidable between a first position wherein the indexing means are inserted within one of the openings and a second position wherein the indexing means are outside of the openings, the detent member being rotatable with respect to the support when located in the second position.

12. An assembly as described in claim 11, wherein the indexing means include a pin supporting member, a pin mounted to the pin supporting member, and means for adjusting the radial position of the pin with respect to the pin supporting member.

13. An assembly as described in claim 12, wherein the means for adjusting the radial position of the pin include an elongate, arcuate slot within the pin supporting member and means for releasably mounting the pin at least partially within the slot.

14. An assembly as described in claim 11, including means for resiliently urging the detent member towards the indexing means.

15. An assembly as described in claim 10, wherein the plate cylinder includes a plurality of images upon the outer surface thereof, each of the openings within the detent member being aligned with one of the images.

16. An assembly as described in claim 10, wherein the indexing means include a pin having a tapered head portion, the openings within the detent member having tapered configurations for receiving the tapered head portion of the pin.

17. An assembly as described in claim 11, wherein the means for rotating the index means include a shaft assembly, a gear secured to the shaft assembly, the indexing means being secured to and rotatable with the shaft assembly.

* * * * *